US008997625B2

(12) United States Patent
Murai et al.

(10) Patent No.: US 8,997,625 B2
(45) Date of Patent: Apr. 7, 2015

(54) HYDRAULIC FEED-RATE CONTROL APPARATUS

(75) Inventors: Takahiro Murai, Namerikawa (JP); Hideki Uchiuzo, Namerikawa (JP); Minoru Ihara, Uozu (JP)

(73) Assignee: SUGINO Machine Limited, Uozu-shi, Toyama (JP)

( * ) Notice: Subject to any disclaimer, the term of this patent is extended or adjusted under 35 U.S.C. 154(b) by 472 days.

(21) Appl. No.: 13/534,868

(22) Filed: Jun. 27, 2012

(65) Prior Publication Data

US 2013/0032227 A1 Feb. 7, 2013

(30) Foreign Application Priority Data

Aug. 2, 2011 (JP) ..... 2011-169330

(51) Int. Cl.
*F15B 11/046* (2006.01)
*F15B 15/22* (2006.01)

(52) U.S. Cl.
CPC ..... *F15B 11/046* (2013.01); *F15B 15/22* (2013.01)

(58) Field of Classification Search
USPC ..... 91/358 R, 407
See application file for complete search history.

(56) References Cited

U.S. PATENT DOCUMENTS

| | | | | |
|---|---|---|---|---|
| 3,362,266 | A * | 1/1968 | Krafft | 91/407 |
| 3,608,437 | A * | 9/1971 | Little et al. | 91/407 |
| 3,663,138 | A * | 5/1972 | Petroff | 408/130 |
| 3,677,141 | A * | 7/1972 | Lagerqvist et al. | 91/407 |
| 2010/0247254 | A1 * | 9/2010 | Uchiuzo et al. | 408/130 |

FOREIGN PATENT DOCUMENTS

| | | |
|---|---|---|
| JP | 61-7860 | 1/1986 |
| JP | 2011-000666 | 1/2011 |
| JP | 2011000666 A * | 1/2011 |

* cited by examiner

*Primary Examiner* — Thomas E Lazo
(74) *Attorney, Agent, or Firm* — Merchant & Gould P.C.

(57) ABSTRACT

A hydraulic feed-rate control apparatus pushes out a fluid by a main piston to a reservoir chamber via feed-rate adjustment mechanisms and flow passages and adjusts a feed rate of a reciprocating body; the adjustment mechanisms comprises first and second throttle valves arranged at front ends of a cylinder and adjusting flow rates of the fluid flowing into the flow passages; the main piston comprises an auxiliary piston integrally moving, and opening and closing the second throttle valve; and the auxiliary piston comprises an outer peripheral portion fitted in the second throttle valve and closed, a concave portion formed between a front portion and rear portion of the outer peripheral portion, a circulation hole formed in an inner peripheral portion of the auxiliary piston, rear-portion escape holes communicating the rear portion and the circulation hole, and concave-portion escape holes communicating the concave portion with the circulation hole.

4 Claims, 7 Drawing Sheets

HYDRAULIC FEED-RATE CONTROL APPARATUS

This application claims benefit of Ser. No. 2011-169330, filed 2 Aug. 2011 in Japan and which application is incorporated herein by reference. To the extent appropriate, a claim of priority is made to the above disclosed application.

BACKGROUND OF THE INVENTION

1. Field of the Invention

The present invention relates to a hydraulic feed-rate control apparatus, and in particular, to the apparatus for changing a feed rate from a creeping speed to a fast speed, and thereafter changing the fast speed again to the creeping speed.

2. Description of the Related Art

With respect to a hydraulic feed-rate control apparatus for rotating and reciprocating a rotary tool such as a drill, a tap, a reamer, and a mill, and controlling a feed rate of a drill unit and the like for machining a workpiece, there exists a control device capable of a two-stages adjustment of a fast speed and a creeping speed. The hydraulic feed-rate control apparatus feeds the rotary tool at the fast speed in drilling the workpiece by the rotary tool and changes the fast speed to the creeping speed just before the tool penetrates the workpiece (for example, Japanese Patent Laid-Open Publication No. 2011-666 and Japanese Utility Model Laid-Open Publication No. S61-7860).

However, a conventional apparatus feeds a drill at a fast speed, when the drill drills a workpiece, and shortens a drilling time thereof; the apparatus changes the fast speed to a slow speed just before the drill penetrates the workpiece; and the apparatus feeds the drill at the fast speed same as in drilling the workpiece even when the drill contacts the workpiece and starts drilling it. Therefore, there is a problem that a burr and a drilled-hole displacement tend to occur when the drill bites the workpiece at a start of drilling it.

Furthermore, with respect to a flow rate adjustment, since a minute flow-rate adjustment is required, there is a problem that: in a feed-rate control apparatus utilizing in particular a hydraulic pressure, a hydraulic oil made to be gel results in being clogged at a valve and a groove and affects a minute speed control when the oil is used for a long time.

SUMMARY OF THE INVENTION

In order to solve the problems above mentioned, the present invention is originated and provides a hydraulic feed-rate control apparatus that can accurately change a feed rate from a creeping speed to a fast speed and thereafter change the fast speed again to the creeping speed.

A hydraulic feed-rate control apparatus of a first aspect of the invention comprises: a cylindrical body; a cylinder provided inside the body; a main piston reciprocally arranged in the cylinder; a main-piston rod coupled to the main piston and movably arranged in front and rear directions; a fluid pressure chamber provided at a front of the main piston and in which a fluid is reserved; a reservoir chamber provided at a rear of the main piston and in which the fluid is reserved; flow passages configured to communicate with the reservoir chamber and to be provided between the body and the cylinder; feed-rate adjustment mechanisms configured to be provided at front ends of the cylinder, to control a flow rate of the fluid flowing into the flow passages from the fluid pressure chamber, and to adjust a moving speed of the main piston; and a differential piston configured to be arranged at a rear of the reservoir chamber and to be movably provided in the front and rear directions with slidingly contacting an inner peripheral face of the body and the main-piston rod, wherein the feed-rate adjustment mechanisms comprises a first throttle valve and a second throttle valve configured to be provided at the front ends of the cylinder and to respectively adjust flow rates of the fluid flowing into the flow passages from the fluid pressure chamber, wherein the main piston comprises an auxiliary piston integrally moving, and opening and closing the second throttle valve, and wherein the auxiliary piston comprises: an outer peripheral portion configured to be fitted in the second throttle valve and to be closed; a concave portion formed between a front portion and rear portion of the outer peripheral portion; a circulation hole formed at an inner peripheral portion of the auxiliary piston; rear-portion escape holes configured to communicate the rear portion of the outer peripheral portion with the circulation hole; and concave-portion escape holes configured to communicate the concave portion with the circulation hole.

According to the configuration thus described, the hydraulic feed-rate control apparatus of the first aspect comprises the first throttle valve and the second throttle valve configured to respectively adjust the flow rates of the fluid flowing into the flow passages from the fluid pressure chamber, and thereby can regulate the flow rates of the fluid by the first and second throttle valves, respectively, when the fluid pushed out of the fluid pressure chamber by the main piston pass through the first and second throttle valves; therefore, it is possible to properly adjust the moving speed of the main piston.

Furthermore, the auxiliary piston comprises the concave portion formed between the front portion and rear portion of the outer peripheral portion, fitted in the second throttle valve, and closed; thereby, in a state that the front portion of the auxiliary piston closes the second throttle valve and it is closed, it is possible to open only the first throttle valve and set the moving speed of the main piston to be slow (creeping speed).

Then it is possible to open the second throttle valve in a state that: the auxiliary piston is pushed by the main-piston rod from the state of the second throttle valve being closed; is further moved; passes through the rear-portion escape holes, the circulation hole, and the concave-portion escape holes from the fluid pressure chamber; contracts more in diameter than the outer peripheral portion; and the chamber to the second throttle valve are communicated.

Therefore, in a state of also the second throttle valve being opened in addition to the first throttle valve, it is possible to set the moving speed of the main piston to be fast (increased speed) because the flow rates of the fluid are increased.

In a state that: the auxiliary piston being pushed by the main-piston rod and moved further from the state; and the rear portion of the auxiliary piston closes the second throttle valve and it is closed, it is possible to set the moving speed of the main piston to be slow (creeping speed) because only the first throttle valve is open.

Accordingly, for example, when the hydraulic feed-rate control apparatus of the first aspect of the invention is applied to a drill unit for drilling a workpiece, the apparatus makes it possible to meticulously set feed rates matched with drilling conditions by: setting the moving speed of the main piston to be slow (creeping speed in biting the workpiece) when a drill contacts and bites the workpiece at a start of drilling it; changing the moving speed to be fast during drilling the workpiece (drilling speed in drilling the workpiece); and changing the moving speed again to be slow (creeping speed just before penetrating the workpiece) just before the drill penetrates the workpiece.

A hydraulic feed-rate control apparatus of a second aspect of the invention is the hydraulic feed-rate control apparatus according to the first aspect, wherein at least one of the first throttle valve and the second throttle valve comprises: a rotary valve body configured to be freely turnably arranged in the cylinder and including a flow rate adjustment portion configured to be turned and to adjust a flow rate of the fluid flowing into a communication hole from the fluid pressure chamber, which the communication hole is bored in the cylinder and communicates with the flow passages; a knob configured to rotate the rotary valve body; and a rotation stopper configured to regulate turning the knob.

According to the configuration thus described, when an opening degree of any of the first throttle valve and the second throttle valve is adjusted, by turning respective knobs and respective rotary valve bodies being turned, it is possible to suitably adjust respective flow rates of the fluid flowing into respective communication holes of the cylinder from the fluid pressure chamber.

Furthermore, after any of the knobs is turned and the flow rate is adjusted by the rotation stopper for regulating the turning of the knob, it is possible to stably hold adjusted a position by regulating the turning of the knob and avoiding a careless operation by regulating the turning thereof.

A hydraulic feed-rate control apparatus of a third aspect of the invention is the hydraulic feed-rate control apparatus according to the first aspect or the second aspect and further comprises at least one of a filter configured to filtrate the fluid passing through the first throttle valve and a filter configured to filtrate the fluid passing through the second throttle valve.

According to the configuration thus described, because it is possible to suppress the fluid from being clogged in the first and second throttle valves by comprising the filter for filtrating the fluid and to accurately adjust the flow rates thereof, it is possible to suitably perform the creeping-speed control of the drill unit.

The hydraulic feed-rate control apparatus of the present invention can change the feed rate from the creeping speed to the fast speed and thereafter change the fast speed again to the creeping speed.

Therefore, the hydraulic feed-rate control apparatus of the invention can be suitably adopted, in particular, to a feed control of a drill unit for drilling and can effectively suppress a defect such as a drilled-hole displacement and a burr occurrence and achieve a good finish quality by maintaining an optimum feed rate during drilling a workpiece and by changing the feed rate to the creeping speed in biting the workpiece and just before penetrating it.

BRIEF DESCRIPTION OF THE DRAWINGS

FIG. 3A is a partially enlarged drawing of FIG. 2; FIG. 3B shows a front view of the apparatus in biting the workpiece.

FIG. 4A is a partially enlarged drawing of FIG. 2; FIG. 4B shows a front view of the apparatus in drilling the workpiece.

FIG. 5A is a partially enlarged drawing of FIG. 2; FIG. 5B shows a front view of the apparatus just before penetrating the workpiece.

FIG. 6A shows a state when a flow rate of a hydraulic oil is maximum; FIG. 6B shows one example of a flow rate within an adjustment range of the hydraulic oil; and FIG. 6C shows a state when a flow of the hydraulic oil is shut off.

FIG. 7A shows a state when the flow rate of the hydraulic oil is maximum; FIG. 7B shows one example of a flow rate within an adjustment range of the hydraulic oil; and FIG. 7C shows a state when a flow of the hydraulic oil is shut off.

PREFERRED EMBODIMENT(S) FOR CARRYING OUT THE INVENTION

Below will be described an embodiment of a hydraulic feed-rate control apparatus B relating to an embodiment of the present invention in detail with reference to drawings as needed. For convenience of descriptions, assuming a state of the hydraulic feed-rate control apparatus B being attached to an automatic drill unit A shown in FIG. 1, front and rear directions are defined so that a main-piston rod 5 side of the hydraulic feed-rate control apparatus B is a rear side and a knobs 8, 9 side is a front side.

Figure 1:
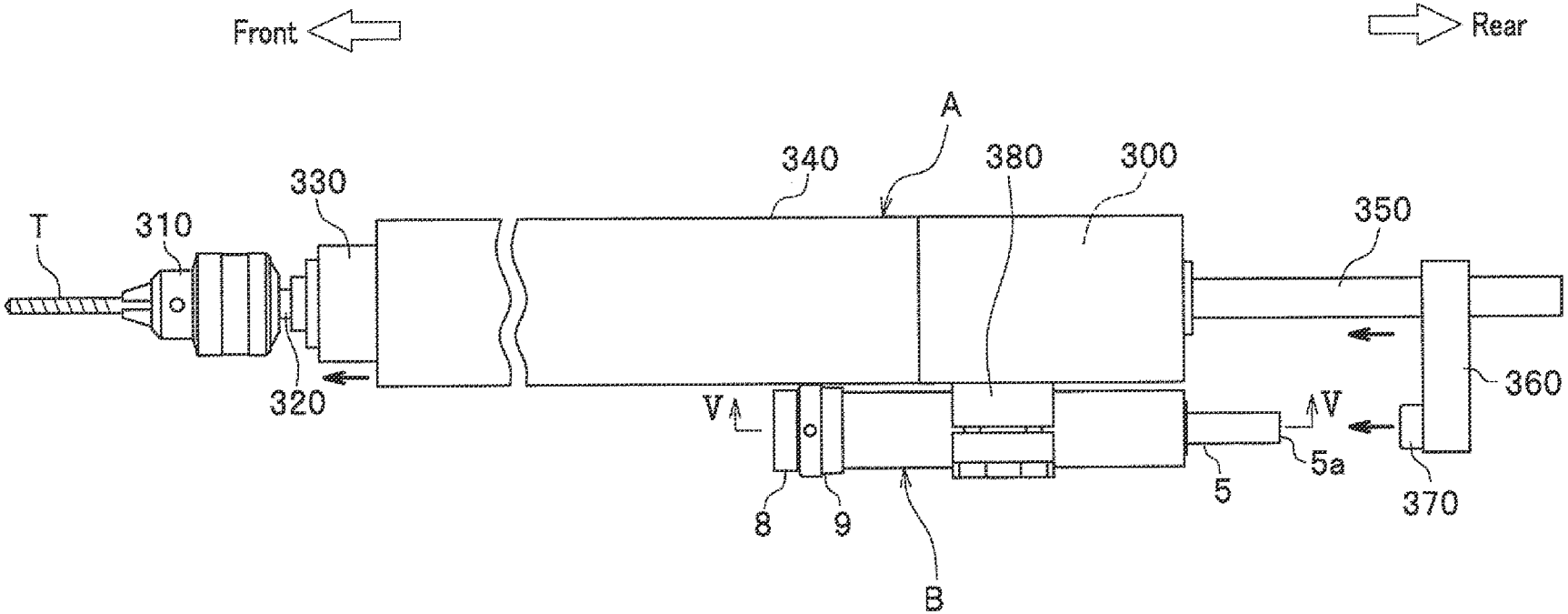
FIG. 1 is a front view showing a drill unit where a hydraulic feed-rate control apparatus is mounted relating to an embodiment of the present invention.
Figure 3A:
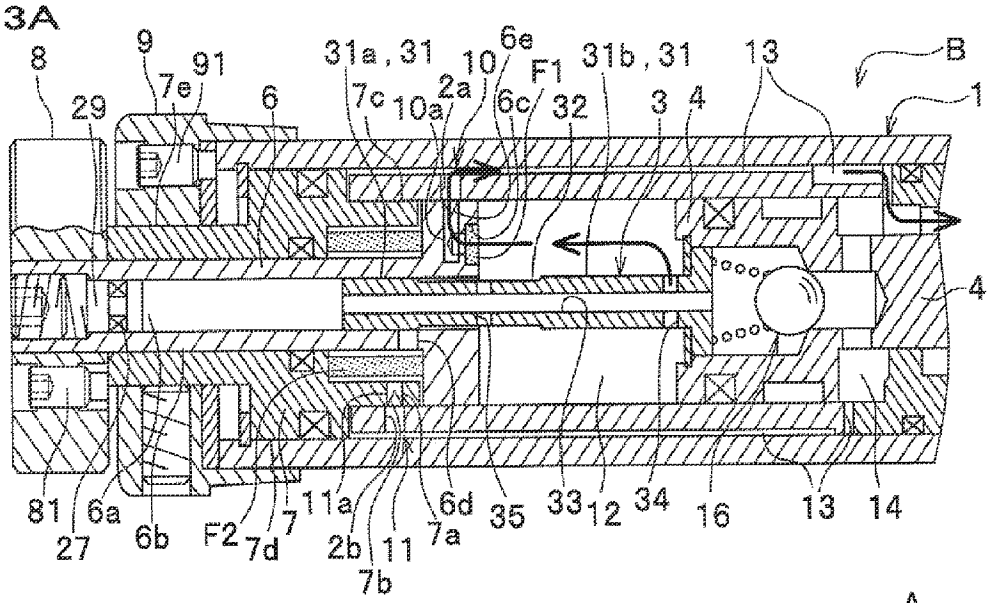
FIGS. 3A and 3B are drawings illustrating operations of a creeping-speed feed of the hydraulic feed-rate control apparatus in biting a workpiece relating to the embodiment.
Figure 3B:
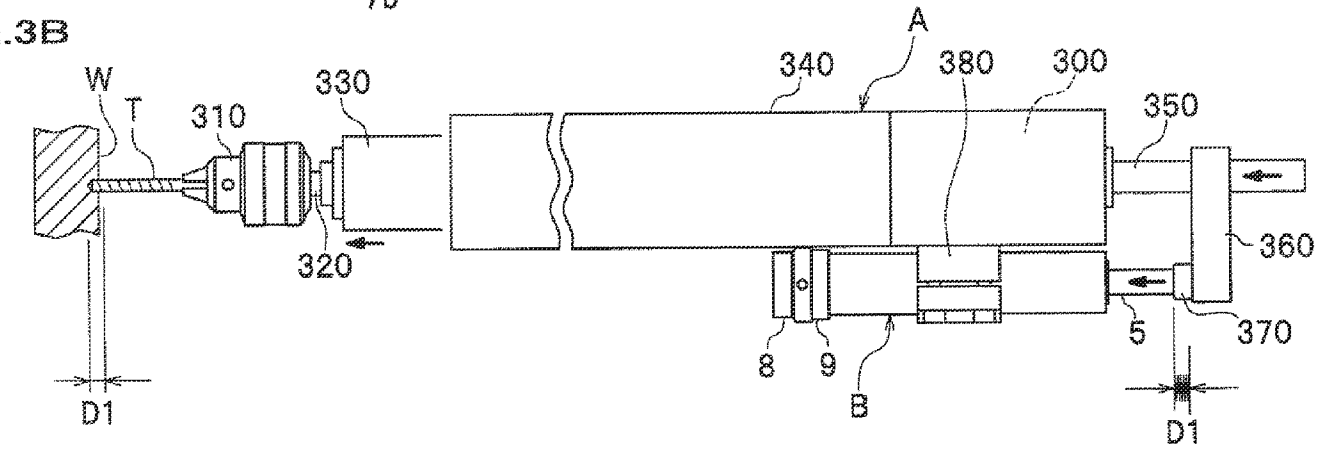

The hydraulic feed-rate control apparatus B of the embodiment can be, as shown in FIG. 1, suitably mounted on the automatic drill unit A, which makes one of rotary tools such as a drill, a tap, a reamer, and a mill rotate and reciprocate, and machines a workpiece W (see FIG. 3B).

In addition, the hydraulic feed-rate control apparatus B is an apparatus actuated by a fluid pressure such as a hydraulic pressure and a pneumatic pressure; the apparatus B is hereinafter described by citing an example of being actuated by the hydraulic pressure.

The drill unit A comprises a chuck 310 configured to grip a drill T of a rotary tool, a main shaft 320 to which the chuck 310 is attached, a ram 330 configured to move forward and rearward the main shaft 320, an electric motor M for rotationally driving the main shaft 320, a feed device 300 configured to linearly reciprocate the ram 330, a housing 340 where the motor M and the feed device 300 are housed, a bar 350 reciprocally provided at the housing 340, a plate member 360 fixed to the bar 350, a contact member 370 fixed to the plate member 360, and a coupling member 380 configured to couple the drill unit A and the hydraulic feed-rate control apparatus B.

The hydraulic feed-rate control apparatus B is a control apparatus that can smoothly control a feed rate of the feed device 300 that makes the drill T, ram 330, and the like of the drill unit A by controlling a flow rate of a hydraulic oil.

Figure 2:
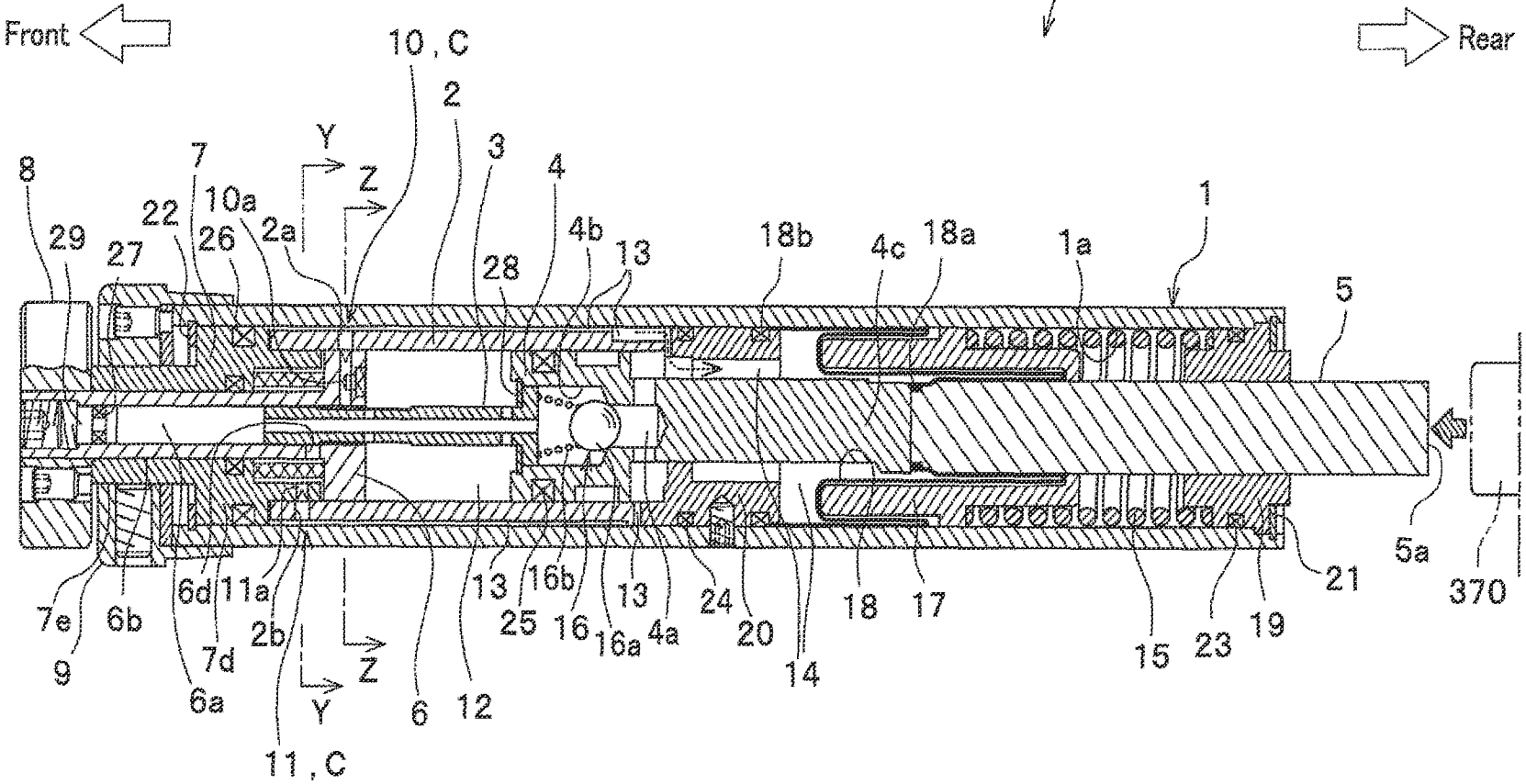
FIG. 2 is a V-V section view of FIG. 1 showing a configuration of the hydraulic feed-rate control apparatus relating to the embodiment.

As shown in FIG. 2, the hydraulic feed-rate control apparatus B comprises a cylinder 2 provided inside a cylindrical body 1, a main piston 4 reciprocally arranged in the cylinder 2, the main-piston rod 5 coupled to the piston 4 and arranged movably in the front and rear directions, an auxiliary piston 3 integrally fixed to a front end of the piston 4, a fluid pressure chamber 12 provided at a front of the piston 4, a reservoir chamber 14 provided at a rear of the piston 4, and feed-rate adjustment mechanisms C provided at front ends, flow passages 13 configured to communicate with the mechanisms C and the reservoir chamber 14, and a differential piston 17 arranged at a rear of the chamber 14.

With respect to the hydraulic feed-rate control apparatus B, the main-piston rod 5 pushed by the contact member 370 moves forward, and thereby, the apparatus B is configured to move the main piston 4 integrated with the rod 5 forward and to push out a hydraulic oil in the fluid pressure chamber 12 to the reservoir chamber 14 via the feed-rate adjustment mechanisms C and the flow passages 13. That is, the hydraulic feed-rate control apparatus B is an apparatus for controlling a feed rate of the ram 330 by: adjusting a flow rate of the hydraulic oil in the fluid pressure chamber 12, which the flow rate is sent out by the piston 4, by means of the first throttle valve 10 and the second throttle valve 11; and controlling a proceeding speed of the piston 4.

The main-piston rod 5 essentially consists of a cylindrical member, is inserted through a lid member 19, a spring 15, and the differential piston 17, and a BELLOFRAM® 18 and the main piston 4 are fixed at a front end of the rod 5.

The body 1 is an outer case of the hydraulic feed-rate control apparatus B and essentially consists of a cylindrical body fixed to an outer peripheral portion of the drill unit A. On a front side of the body 1 are the first knob 8 and the second knob 9; on a rear side thereof is arranged the main-piston rod 5. In an inner peripheral face 1*a* of the body 1 from the rear side to front side thereof in order are arranged a stopper ring 21, the lid member 19, the spring 15, the differential piston 17, the BELLOFRAM® 18, a spacer 20, the cylinder 2, the flow passages 13, a second rotary valve body 7, and a stopper ring 22.

The lid member 19 is a member configured to support the main-piston rod 5 so as to freely move forward and rearward and to close a rear-side opening end of the body 1. The lid member 19 is fitted inside the body 1 through a seal member 23 and is fixed to the body 1 by the stopper ring 21.

The spring 15 is a compression coil spring existing in a compressed state between the lid member 19 and the differential piston 17 in the body 1 and pushes the differential piston 17 and the BELLOFRAM® 18 in the front direction by a spring force of the spring 15.

The differential piston 17 essentially consists of an approximately cylindrical member attached to the inner peripheral face 1*a* of the body 1 and an outer peripheral face of the main-piston rod 5 movably in the front and rear directions, with the cylindrical member slidingly contacting therewith. The differential piston 17 is configured so that the BELLOFRAM® 18 is interposed at a rear position of the reservoir chamber 14, and so as to move by a hydraulic pressure of a hydraulic oil in the chamber 14 with resisting the spring force of the spring 15.

The BELLOFRAM® 18 is a cylindrical elastic member for separating the reservoir chamber 14 and the differential piston 17, preventing the hydraulic oil in the chamber 14 from leaking to the differential piston 17 side, and making the piston 17 move forward and rearward by a hydraulic pressure according to a flow rate of the hydraulic oil flowed in the chamber 14; the cylindrical elastic member consists of a thin rubber member like a diaphragm.

The reservoir chamber 14 is a region for making the BELLOFRAM® 18 and the differential piston 17 move rearward by a hydraulic pressure of the hydraulic oil due to the hydraulic oil in the fluid pressure chamber 12 being pushed out and flowing into the reservoir chamber 14 from the flow passages 13 through one of the feed-rate adjustment mechanisms C when the main-piston rod 5 is pushed (see FIG. 3A in conjunction with FIG. 2).

Furthermore, the reservoir chamber 14 is configured so that the hydraulic oil in the reservoir chamber 14 opens a valve body 16*a* of a check valve 16 against a valve spring 16*b* thereof and flows in the fluid pressure chamber 12 through the valve 16, when the contact member 370 is moved rearward, a push force toward the main-piston rod 5 in the front direction is released, and the differential piston 17 is moved forward by the spring force of the spring 15. The reservoir chamber 14 is formed of the outer peripheral face of the main piston 4, the inner peripheral face of the spacer 20, and the BELLOFRAM® 18.

In the spacer 20 the main piston 4 is freely movably inserted in an axial direction thereof, and the spacer 20 essentially consists of an approximately cylindrical member fixed to the inner peripheral face 1*a* of the body 1. The spacer 20 also performs a function of a stopper of the piston 4.

The cylinder 2 is a cylindrical member forming an inner side wall of the fluid pressure chamber 12 and is fitted inside the inner peripheral face 1*a* of the body 1 through the flow passages 13. Near a rear side in the cylinder 2 is freely reciprocally fitted the main piston 4; near a front side in the cylinder 2, therein are turnably fitted a first rotary valve body 6 and the second rotary valve body 7. Near the front side in the cylinder 2 are provided a first communication hole 2*a*, which is bored at a position matched with a first flow-rate adjustment portion 10*a* of the first throttle valve 10; and a second communication hole 2*b*, which is bored at a position matched with a second flow-rate adjustment portion 11*a* of the second throttle valve 11.

The main piston 4 is a member configured to reciprocate integrally with the main-piston rod 5, to push out the hydraulic oil in the fluid pressure chamber 12, and to make the oil flow to flow passages 13 sides through the feed-rate adjustment mechanisms C, when the rod 5 is pushed to the contact member 370. The main piston 4 comprises a return flow passage 4*a* bored at a center portion thereof in the axial direction thereof, a piston flow passage 4*b* approximately cylindrically formed on a fluid pressure chamber 12 side, and a bar-like portion 4*c* columnarly formed on a reservoir chamber 14 side. The main piston 4 is freely reciprocally inserted in the cylinder 2 through a seal 25.

The return flow passage 4*a* communicates with the reservoir chamber 14, the flow passages 13, and the piston flow passage 4*b*. In the piston flow passage 4*b* are provided the check valve 16, and the stopper ring 28 through the auxiliary piston 3.

The check valve 16 is a valve for preventing the hydraulic oil in the fluid pressure chamber 12 from flowing to the flow passages 13 sides through an inside of the auxiliary piston 3, the piston flow passage 4*b*, and the return flow passage 4*a*. The check valve 16 is configured with a valve seat formed at an inner bottom of the piston flow passage 4*b*, the valve body 16*a* for closing the seat, and the valve spring 16*b* for pushing the body 16*a*.

The valve body 16*a* is formed of a steel ball. The valve spring 16*b* essentially consists of a compression coil spring whose front end pushes the auxiliary piston 3 forward and whose rear end pushes the valve body 16*a* rearward.

As shown in FIG. 3A, the auxiliary piston 3 essentially consists of an approximately cylindrical member, is arranged at a front end of the main piston 4, integrally reciprocates, and comprises: an outer peripheral portion 31 fitted inside an auxiliary cylinder chamber 6*a*; a concave portion 32 formed to contract more in diameter than the outer peripheral portion 31 between a front portion 31*a* of the portion 31 and the rear portion 31*b* thereof; a circulation hole 33 formed throughout an inner peripheral portion of the piston 3; rear-portion escape holes 34 for communicating the rear portion 31*b* with the hole 33; and concave-portion escape holes 35 for communicating the concave portion 32 with the hole 33.

According to the configuration thus described, in a state of the front portion 31*a* of the auxiliary piston 3 being fitted inside the auxiliary cylinder chamber 6*a*, the second throttle valve 11 is closed.

Furthermore, the valve 11 is opened in a state that: the auxiliary piston 3 is pushed by the main-piston rod 5 from the state of the second throttle valve 11 being closed; is further moved; passes through the rear-portion escape holes 34, the circulation hole 33, and the concave-portion escape holes 35 from the fluid pressure chamber 12; contracts more in diameter than the outer peripheral portion 31; and the chamber 12 to the second throttle valve 11 are communicated.

Moreover, when the auxiliary piston 3 is pushed by the main-piston rod 5 (see FIG. 2) and is moved as far as the rear portion 31*b* of the auxiliary piston 3 is closed, it is possible to close the second throttle valve 11.

The fluid pressure chamber 12 is a cylinder chamber, which is a pressure chamber of the hydraulic oil, and is formed of the cylinder 2, the main piston 4, the auxiliary piston 3, the first rotary valve body 6, and the like.

The flow passages 13 are formed between the inner wall of the body 1 and the outer wall of the cylinder 2 and are configured so that the hydraulic oil having passed the first throttle valve 10 and the second throttle valve 11 described later flows into the reservoir chamber 14.

The feed-rate adjustment mechanisms C are a valve device configured to adjust a moving speed of the main piston 4 by controlling the flow rate of the hydraulic oil flowing into the flow passages 13 from the fluid pressure chamber 12 and are plurally arranged at the front end of the cylinder 2. The feed-rate adjustment mechanisms C are mainly configured with the first and second throttle valves 10, 11 for respectively adjusting the flow rates of the hydraulic oil flowing into the flow passages 13 from the fluid pressure chamber 12.

The first throttle valve 10 mainly comprises the first rotary valve body 6 including the first flow-rate adjustment portion 10*a* for adjusting a flow rate of the hydraulic oil flowing into the first communication hole 2*a*, which communicates with a relevant flow passage 13, from the fluid pressure chamber 12; the first knob 8 capable of turning the valve body 6; and the auxiliary piston 3.

The first rotary valve body 6 is a member for performing as an adjustment member a function of adjusting the flow rate of the hydraulic oil, which flows into the flow passage 13 from the fluid pressure chamber 12, and the moving speed of the main piston 4; the valve body 6 is turnably arranged inside the cylinder 2 and the second rotary valve body 7.

The first rotary valve body 6 comprises: the auxiliary cylinder chamber 6*a* configured to communicate with the circulation hole 33 formed in the auxiliary piston 3; a cylindrical portion 6*b* outside which the second rotary valve body 7 is turnably fitted; a first inflow port 6*c* formed openly to the fluid pressure chamber 12; a filter F1 attached to the port 6*c*; a second inflow port 6*d* formed at the cylindrical portion 6*b*; a first flow-rate adjustment groove 6*e* configured to communicate with the port 6*c* (see FIGS. 6A to 6C); a disc portion 6*f* formed like a collar; a stopper 29 configured to close the auxiliary cylinder chamber 6*a*; and the first knob 8 configured to adjust a flow rate of the port 6*c*.

The auxiliary cylinder chamber 6*a* essentially consists of a filling chamber of the hydraulic oil formed inside the first rotary valve body 6 and communicates with the fluid pressure chamber 12 through the circulation hole 33 formed in the auxiliary piston 3.

The first inflow port 6*c* is a flow passage formed at the disc portion 6*f* (see FIG. 6A) so as to communicate from the fluid pressure chamber 12 to the first flow-rate adjustment portion 10*a* and serves a function of a flow passage for a creeping-speed feed (see FIG. 3A).

The filter F1 has a function of filtrating the hydraulic oil flowing into the inflow port 6*c*, thereby suppressing the hydraulic oil from being clogged in a first flow-rate adjustment groove 6*e* of the first throttle valve 10, and accurately adjusting a minute flow rate of the hydraulic oil.

The second inflow port 6*d* is a flow passage for sending the hydraulic oil in the fluid pressure chamber 12 to a second flow-rate adjustment portion 11*a* of the second throttle valve 11 existing outside the cylindrical portion 6*b*, and is a main flow passage in drilling the workpiece W.

Figure 4A:
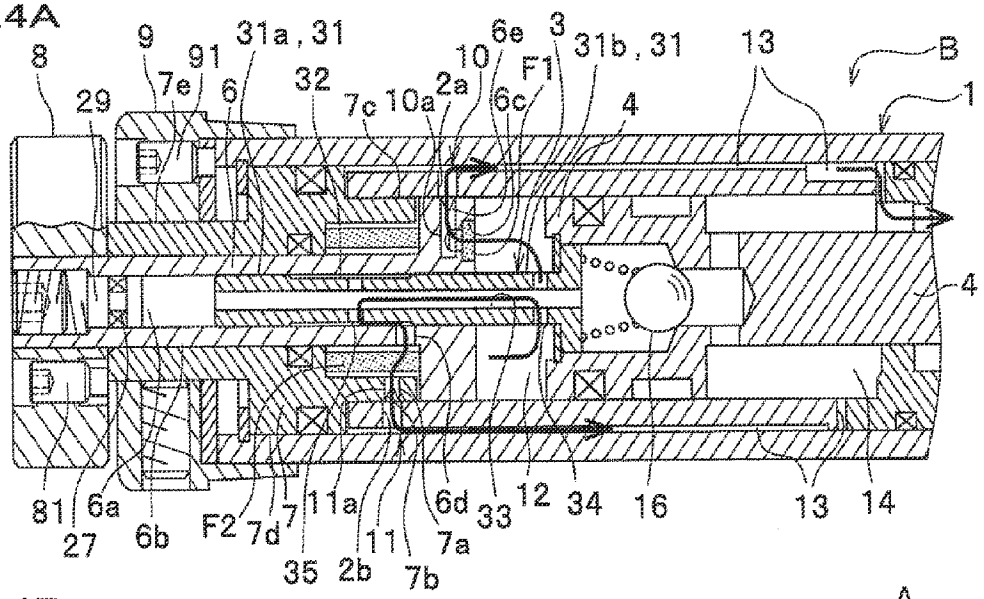
FIGS. 4A and 4B are drawings illustrating operations of drilling feed of the hydraulic feed-rate control apparatus in drilling the workpiece relating to the embodiment.

Specifically, because the second inflow port 6*d* communicates with the second flow-rate adjustment portion 11*a* of the second throttle valve 11, when the auxiliary piston 3 is located at a position where the port 6*d* and the concave portion 32 formed at the outer peripheral portion 31 of the auxiliary piston 3 so as to contract in diameter are opposed, as shown in FIG. 4A, the hydraulic oil having passed through the rear-portion escape holes 34, the circulation hole 33, and the concave-portion escape holes 35 from the fluid pressure chamber 12 results in a state of communicating from the fluid pressure chamber 12 to the second throttle valve 11 through the concave portion 32.

The first flow-rate adjustment groove 6*e* is a groove for adjusting a flow rate of the hydraulic oil flowing into a relevant flow passage 13 in a state of the hydraulic oil of the fluid pressure chamber 12 flowing into the first inflow port 6*c*.

Figure 6A:
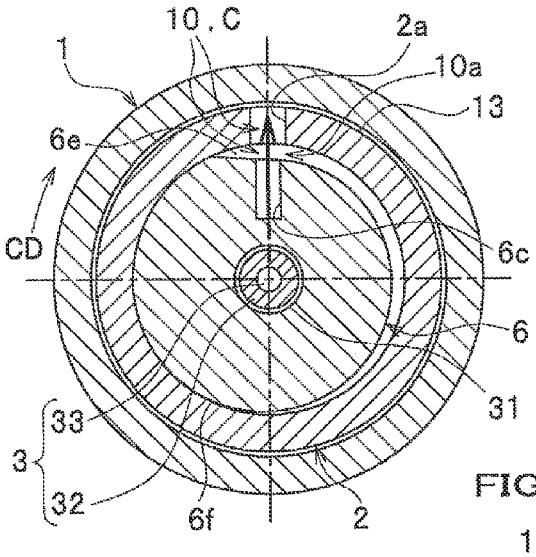
FIGS. 6A, 6B, and 6C are Z-Z enlarged drawings of a first throttle valve in FIG. 2.
Figure 6B:
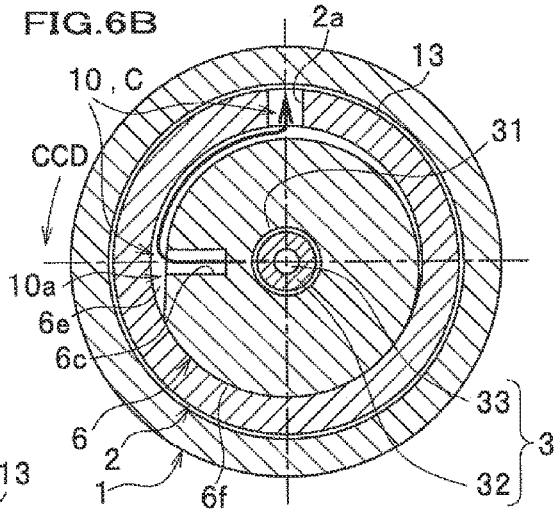
Figure 6C:
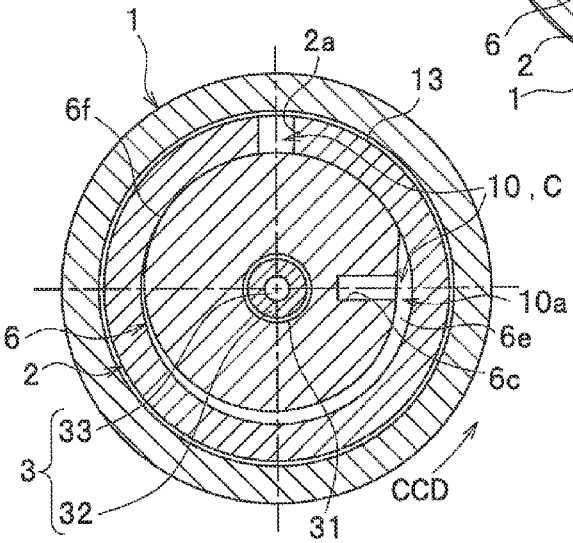

As shown in FIGS. 6A to 6C of Z-Z enlarged drawings of the first throttle valve 10 in FIG. 2, the first flow-rate adjustment groove 6*e* essentially consists of a V-shape groove formed so that a depth of the groove is gradually shallow over equal to more than an approximately half periphery (about three-fourths of an outer periphery of the disc portion 6*f*) from a vicinity of the first inflow port 6*c* of an outer peripheral face of the disc portion 6*f*; an oil passage is formed by the groove 6*e* and the inner wall of the cylinder 2.

The disc portion 6*f* is, as shown in FIG. 3A, a disc-like region forming the first flow-rate adjustment portion 10*a*, the first inflow port 6*c*, and the first flow-rate adjustment groove 6*e* and is fitted inside the fluid pressure chamber 12 on a front side thereof.

The stopper 29 is fitted inside the cylindrical portion 6*b* at a top end thereof through the seal 27 in order to close the front end of the auxiliary cylinder chamber 6*a* into a tightly closed state.

The first knob 8 is a flow-rate control knob for turning the first rotary valve body 6 by performing a turning operation thereto, adjusting a position of the first flow-rate adjustment groove 6*e* and the first inflow port 6*c* with respect to the first communication hole 2*a*, and for adjusting a flow rate of the hydraulic oil flowing from the port 6*c* to the flow passage 13 (see FIGS. 6A to 6C).

Furthermore, at the first knob 8 is provided a stopper screw 81 of a rotation stopper for regulating the turning. The stopper screw 81 is configured to integrally fix the first knob 8 and the second rotary valve body 7 and to be able to regulate the turning.

As shown in FIG. 4A, the second throttle valve 11 is configured to be freely turnably arranged in the cylinder 2 and mainly comprise: the second rotary valve body 7 including the second flow-rate adjustment portion 11*a* for adjusting the flow rate of the hydraulic oil from the fluid pressure chamber 12 flowing into the second communication hole 2*b* bored in the cylinder 2; and the second knob 9 capable of turning the valve body 7.

The second rotary valve body 7 is fitted outside the cylindrical portion 6*b* of the first rotary valve body 6, is turnably inserted in an opening end of the cylinder 2 and the body 1, and performs as an adjustment member a function of adjusting: the flow rate of the hydraulic oil flowing into the flow passage 13 from the fluid pressure chamber 12; and the moving speed of the main piston 4.

The second rotary valve body 7 comprises a valve hole 7*a* configured to communicate with the second inflow port 6*d*, a cylindrical portion 7*c* turnably fitted inside the front end of the cylinder 2, a second flow-rate adjustment groove 7*b* formed on an outer peripheral face of the portion 7*c*, a body closing portion 7*d* turnably fitted inside the body 1, a knob attachment portion 7*e* to which the second knob 9 is attached, and a filter F2 for filtrating the hydraulic oil flowing into the groove 7*b*.

Then, when the turning operation of the second knob 9 is performed, it is possible to adjust the flow rate of the hydraulic oil flowing in the second flow-rate adjustment groove 7*b*.

The valve hole 7*a* is a region for forming a part of a flow passage of the hydraulic oil flowing between the second inflow port 6*d* of the first rotary valve body 6 and a relevant flow passage 13; it is configured that an axial center side of the hole 7*a* communicates with the port 6*d* and an outer peripheral portion side thereof communicates with the passage 13 through the second communication hole 2*b*.

The cylindrical portion 7*c* is a region inside which the valve hole 7*a* formed at the portion 7*c* and the second flow-rate adjustment groove 7*b* are turnably fitted so as to be closed and regulated by the inner peripheral face of the cylinder 2.

Figure 7A:
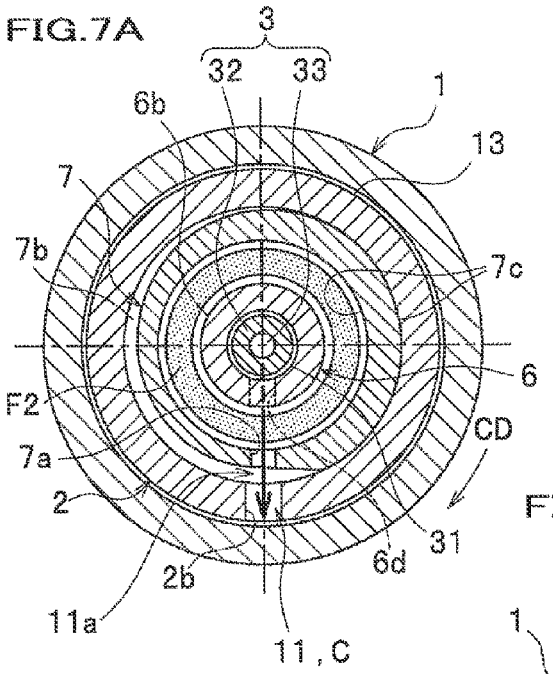
FIGS. 7A, 7B, and 7C are Y-Y enlarged drawings of a second throttle valve in FIG. 2.
Figure 7B:
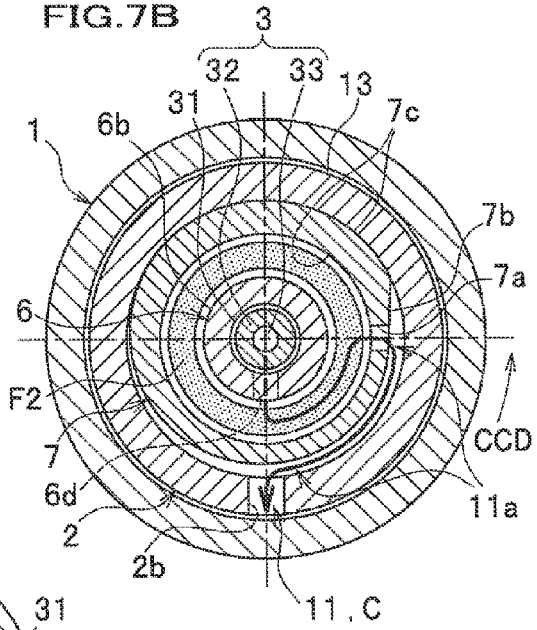
Figure 7C:
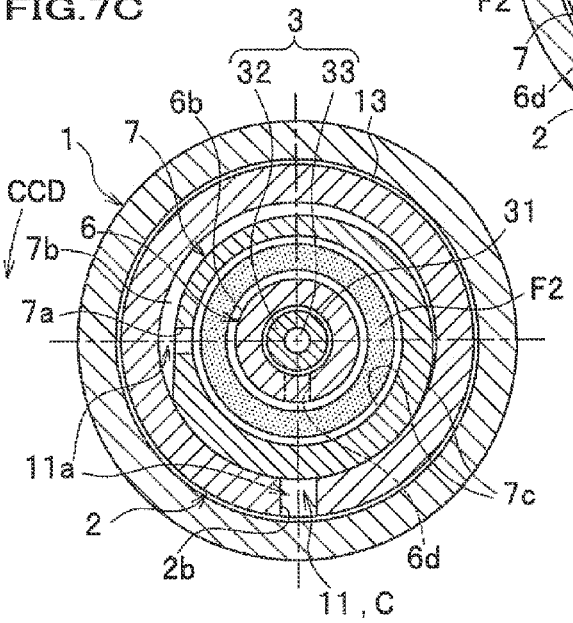

The second flow-rate adjustment groove 7*b* is a groove, similarly to the first flow-rate adjustment groove 6*e*, configured to adjust the flow rate of the hydraulic oil flowing into the flow passage 13 from the second inflow port 6*d*. As shown in FIGS. 7A to 7C, the second flow-rate adjustment groove 7*b* essentially consists of a V-shape groove formed so that a depth of the groove is gradually shallow over equal to more than an approximately half periphery (about three-fourths of an outer periphery of the cylindrical portion 7*c*) from a vicinity of the valve hole 7*a* of the outer peripheral face of the cylindrical portion 7*c*; a flow passage of the hydraulic oil is formed by the groove 7*b* and the inner wall of the cylinder 2.

As shown in FIG. 2, the body closing portion 7*d* is a region for closing the front-side opening end of the body 1, is turnably fitted inside the body 1 through the seal 26, and is fixed to the body 1 by the stopper ring 22.

The knob attachment portion 7*e* is a region outside which the second knob 9 is fitted and screwed and which is freely turnably fitted outside the cylindrical portion 6*b*; the portion 7*e* is formed to be cylindrical.

The second knob 9 is an operation member configured to turn the second rotary valve body 7 by performing the turning operation to the knob 9, and as shown in FIGS. 7A to 7C, is a flow rate control knob for adjusting a position of the second flow-rate adjustment groove 7*b* and the valve hole 7*a* with respect to the second communication hole 2*b*, and for adjusting a flow rate of the hydraulic oil flowing from the port 6*d* of the cylinder chamber 6*a* to the flow passage 13.

As shown in FIG. 4A, at the second knob 9 is the stopper screw 91 of a rotation stopper for regulating the turning. The stopper screw 91 is configured to integrally fix the second knob 9 and the body 1.

Next will be described an action of the hydraulic feed-rate control apparatus B relating to the embodiment of the invention in detail mainly with reference to FIGS. 3A to 5B.

<<Main Body Feed Process of Drill Unit>>

The main body feed process of the drill unit A is a process preceding a drilling processing for feeding the drill T near a machined surface of the workpiece W. In the main body feed process, as shown in FIG. 1, the contact member 370 is in a non-contact state with the main-piston rod 5. Therefore, because the feed device 300 of the drill unit A is not braked by the hydraulic feed-rate control apparatus B, the device 300 can feed the drill T at a fast speed.

<<Creeping-Speed Feed Process in Biting Workpiece>>

As shown by a distance D1 in FIG. 3B, the creeping-speed feed process in biting the workpiece W is a process performed from a position just before the drill T starts drilling the workpiece W to a predetermined feed position at which drilling the workpiece W stably proceeds without a vibration and the like occurring.

For example, because a defect due to such a misalignment and vibration of the drill T tends to occur in drilling the workpiece W by a cutting edge of the drill T, the predetermined feed position is a predetermined position, which can eliminate the defect, and is appropriately set by considering a kind, working diameter, and a rotation speed of a working tool, and a material and shape of the workpiece W.

The creeping-speed feed process in biting the workpiece W is started from a position, at which the contact member 370 contacts the main-piston rod 5, and is performed during a state of the second inflow port 6*d* being closed by the auxiliary piston 3 and a state of the piston 3 moving forward, opening the port 6*d*, and making the second throttle valve 11 open.

As shown in FIG. 3A, in the creeping-speed feed process in biting the workpiece W, the front portion 31*a* of the auxiliary piston 3 is in a state of being fitted inside the auxiliary cylinder chamber 6*a*, the second throttle valve 11 is closed, and only the first throttle valve 10 is open; therefore, the moving speed of the main piston 4 is performed at a slow creeping-speed feed.

Specifically, in the creeping-speed feed process in biting the workpiece W, when the main-piston rod 5 is moved forward, the main piston 4 and the auxiliary piston 3 push the hydraulic oil in the fluid pressure chamber 12, and the oil flows into the reservoir chamber 14 through the first flow-rate adjustment portion 10*a*, the first communication hole 2*a*, and the flow passage 13 from the first inflow port 6*c* opening to the chamber 12. The hydraulic oil flowing into the reservoir chamber 14 pushes and retreats the BELLOFRAM® 18 and the differential piston 17 and generates a braking force due to a fluidization resistance.

<Adjustment of Feed Rate in Creeping-Speed Feed Process in Biting Workpiece>

When the feed rate in the creeping-speed feed process is desired to be adjusted, it is possible to adjust the feed rate by performing the turning operation to the first knob 8 in advance of the adjustment and adjusting the flow rate of the hydraulic oil flowing through the first flow-rate adjustment portion 10*a* of the first throttle valve 10.

Specifically, when the turning operation is performed to the first knob 8 (see FIG. 2) as far as a most right position in a clockwise direction of an arrow mark CD as shown in FIG. 6A, the depth of the first flow-rate adjustment groove 6*e* essentially consisting of the V-shape groove arranged between the first inflow port 6*c* and the first communication hole 2*a* results in being deepest at the position, and the flow rate of the hydraulic oil flowing into the hole 2*a* through the groove 6*e* from the port 6*c* results in being maximum.

Furthermore, when the turning operation is performed to the first knob 8 (see FIG. 2) as far as an intermediate position in a counterclockwise direction of an arrow mark CCD as shown in FIG. 6B, the depth of the first flow-rate adjustment groove 6*e* is reduced, and also the flow rate of the hydraulic oil flowing into the first communication hole 2*a* through the groove 6*e* from the first inflow port 6*c* is reduced.

Furthermore, when the turning operation is performed to the first knob 8 (see FIG. 2) as far as a most left position in the counterclockwise direction of an arrow mark CCD as shown in FIG. 6C, the first communication hole 2*a* is closed by the first rotary valve body 6 and the flow of the hydraulic oil is stopped.

Thus it is possible to adjust the feed rate in the creeping-speed feed process by adjusting a turn angle from the position of the first knob 8 shown in FIG. 6A to the position thereof shown in FIG. 6C and adjusting the flow rate of the hydraulic oil flowing into the first communication hole 2*a*.

<<Drilling Feed Process>>

Figure 4B:
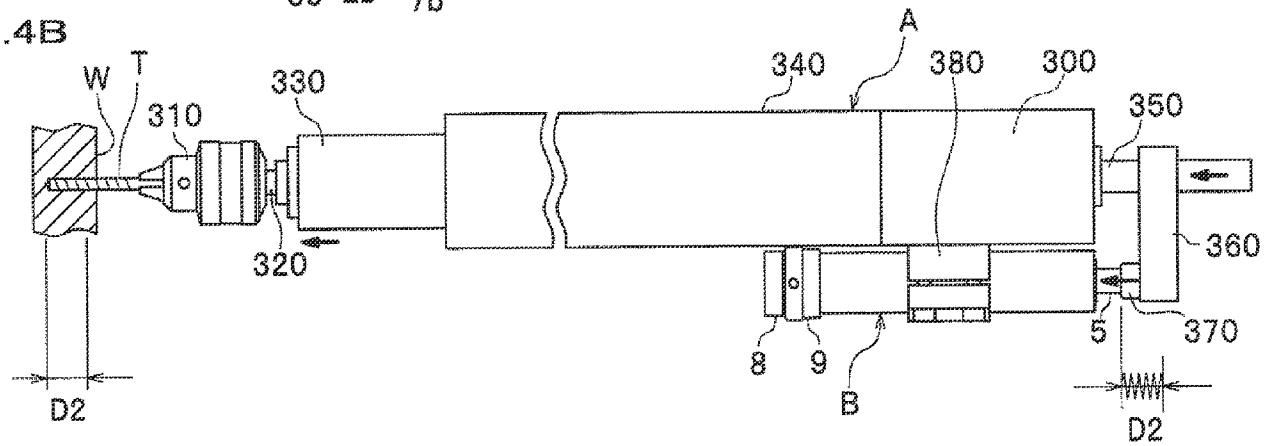

The drilling feed process is, as shown by a distance D2 in FIG. 4B, from a position, at which the creeping-speed feed process in biting the workpiece W is completed, to a position just before a position at which the drill T penetrates a reverse side of the workpiece W.

In the drilling feed process, because a stable drilling condition is obtained in comparison with the creeping-speed feed process in biting the workpiece W and creeping-speed feed process just before penetrating the workpiece W described later, it is possible to feed the drill T at a speed faster than that in the creeping-speed feed process. A feed length and a feed rate in the drilling feed process are appropriately set by considering a material of the workpiece W, a working tool (drill), and the like.

In the drilling feed process, as shown in FIG. 4A, the auxiliary piston 3 is pushed by the main-piston rod 5 and further moved forward; the second inflow port 6*d* is opposed so as to front the concave portion 32, which is contracted in diameter and formed at the outer peripheral portion 31 of the piston 3; a flow route of the hydraulic oil from the fluid pressure chamber 12 as far as the second throttle valve 11 is communicated, through the rear-portion escape holes 34 the circulation hole 33, and the concave-portion escape holes 35, and via the concave portion 32 contracted more in diameter than the outer peripheral portion 31 and formed at the portion 31; and thus the second throttle valve 11 is opened.

In the drilling feed process, the hydraulic oil pushed out of the fluid pressure chamber 12, according to one oil flow route, flows into the reservoir chamber 14 from the first inflow port 6*c*, the first flow-rate adjustment portion 10*a*, the first communication hole 2*a*, and relevant flow passages 13; and, according to the other oil flow route, flows into the reservoir chamber 14 from the second inflow port 6*d* through the second flow-rate adjustment portion 11*a*, the second communication hole 2*b*, and relevant flow passages 13.

Thus in the drilling feed process, because the hydraulic oil in the fluid pressure chamber 12 flows into the reservoir chamber 14 through the flow passages 13 via the two routes, the flow rate of the hydraulic oil flowing into the chamber 14 is large and a fluidization resistance is small. Therefore, because the main piston 4 and the main-piston rod 5 are fast in moving-forward speed and a speed for braking the contact member 370 is small, it is possible to set the feed rate to be fast.

<Feed-Rate Adjustment in Drilling Feed Process>

When the feed rate in the drilling feed process is desired to be adjusted, the feed rate is adjusted by performing the turning operation to the second knob 9 in advance of the adjustment and adjusting a flow rate of the hydraulic oil flowing through the second flow-rate adjustment portion 11*a* of the second throttle valve 11.

Specifically, when the turning operation is performed to the second knob 9 (see FIG. 2) as far as a most right position in the clockwise direction of an arrow mark CD as shown in FIG. 7A, the flow rate of the hydraulic oil flowing through the second flow-rate adjustment portion 11*a* of the second throttle valve 11 results in being maximum and the feed rate is in a fastest state in the drilling feed process.

Furthermore, when the turning operation is performed to the second knob 9 (see FIG. 2) as far as an intermediate position in the counterclockwise direction of an arrow mark CCD as shown in FIG. 7B, the flow rate of the hydraulic oil flowing through the second flow-rate adjustment portion 11*a* of the second throttle valve 11 is reduced, and thereby, it is possible to adjust the feed rate in the drilling feed process to an intermediate speed.

Furthermore, when the turning operation is performed to the second knob 9 (see FIG. 2) as far as a most left position in the counterclockwise direction of an arrow mark CCD as shown in FIG. 7C, the second communication hole 2*b* is closed by the second rotary valve body 7 and the flow of the hydraulic oil is stopped.

Thus it is possible to adjust the feed rate in the drilling feed process by adjusting a turn angle from the position of the second knob 9 shown in FIG. 7A to the position thereof shown in FIG. 7C and adjusting the flow rate of the hydraulic oil flowing through the second flow-rate adjustment portion 11*a* of the second throttle valve 11.

<<Creeping-Speed Feed Process Just Before Penetrating Workpiece>>

Figure 5A:
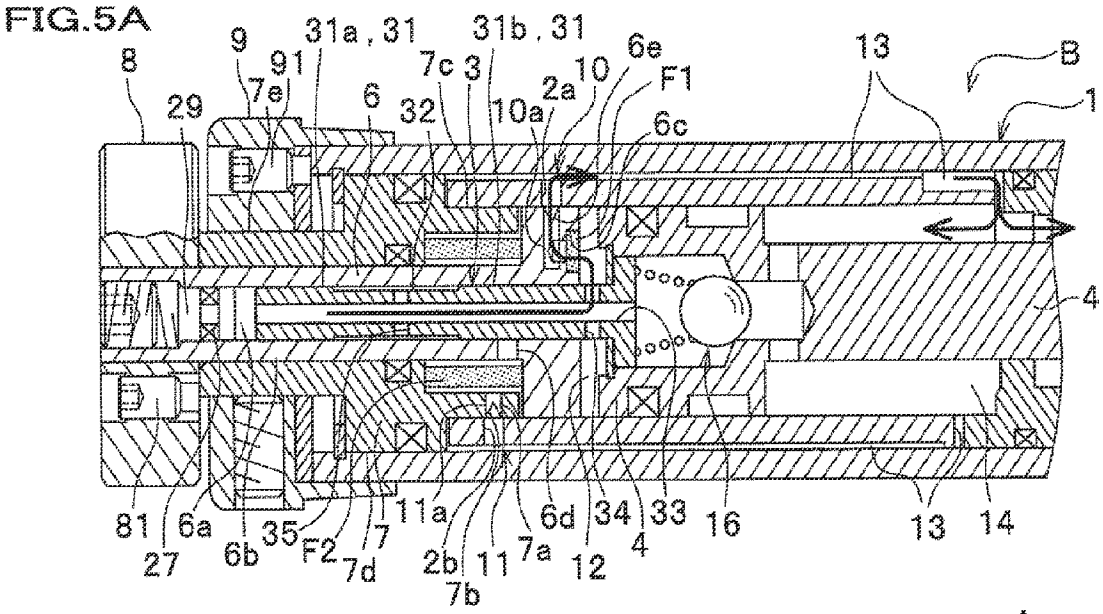
FIGS. 5A and 5B are drawings illustrating operations of a creeping-speed feed of the hydraulic feed-rate control apparatus just before penetrating the workpiece relating to the embodiment.
Figure 5B:
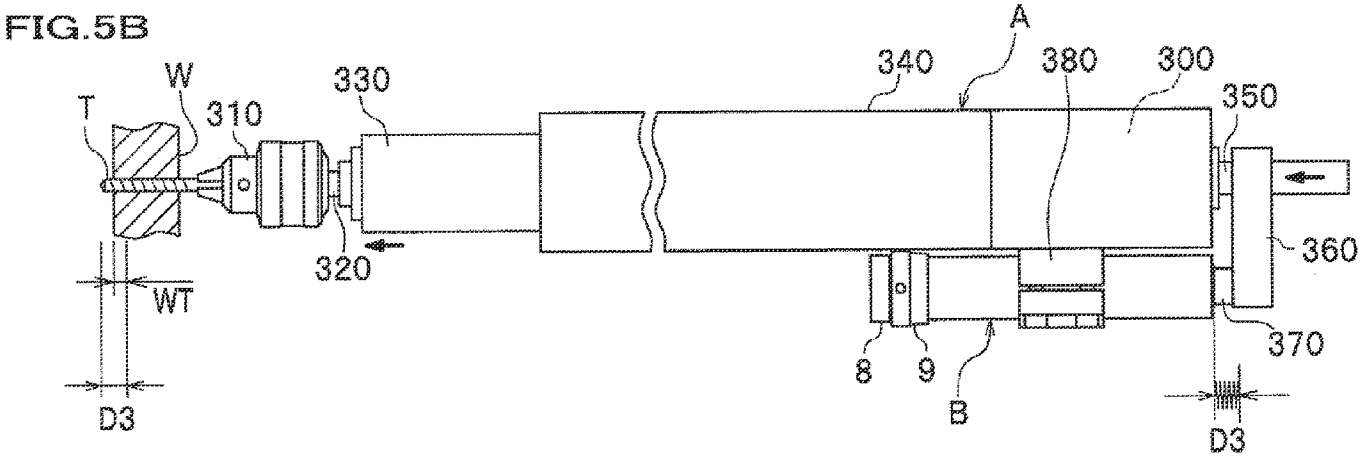

The creeping-speed feed process just before penetrating the workpiece W is a process, as shown by a distance D3 in FIG. 5B, from a predetermined position just before a position at which the drill T penetrates the workpiece W, to a position at which the feed rate is changed to the creeping speed, to a position at which the workpiece W is penetrated, and to a position at which drilling the workpiece W is completed.

With respect to a predetermined position just before a position at which the drill T penetrates the workpiece W, because just before the penetration, for example, a thin skin remaining on the reverse side of the workpiece W is broken and a burr tends to occur around a penetration hole of the workpiece W, the predetermined position is a position, at which it is possible to ensure a required thickness WT (FIG. 5B) on the reverse side of the workpiece W in order to prevent the burr from occurring, and is appropriately set by considering a kind, working diameter, and rotation number of a working tool, and the material and shape of the workpiece W.

The creeping-speed feed process just before penetrating the workpiece W is started from a position at which the auxiliary piston 3 is pushed by the main-piston rod 5 and a rear portion of the piston 3 closes the second throttle valve 11, and it is possible to set the moving speed of the main piston 4 to be small in a state of the valve 11 being closed because only the first throttle valve 10 is open. In addition, because adjustments of a movement and a feed rate in the creeping-speed feed process just before penetrating the workpiece W are similar to those in the creeping-speed feed process in biting the workpiece W, a detailed description thereof will be omitted.

Thus described, by being mounted on the drill unit A, the hydraulic feed-rate control apparatus B of the embodiment can set the moving speed of the main piston 4 to be slow (creeping-speed feed process in biting the workpiece W) when the drill T contacts and bites the workpiece W at a start of drilling the workpiece W; change the moving speed of the main piston 4 to be fast in drilling the workpiece W (drilling feed in drilling the workpiece W); change the moving speed again to be slow (creeping speed just before penetrating the workpiece W) just before the drill T penetrates the workpiece W; and by the feed-rate adjustment mechanisms C, properly adjust the feed rates in the creeping-speed feed and the drilling feed, and meticulously set the feed rates matched with the drilling conditions.

Therefore, the hydraulic feed-rate control apparatus B of the embodiment can effectively suppress a defect such as an occurrence of a misalignment and vibration of a working tool and achieve a good finish quality of the workpiece W.

Thus, although the embodiment of the present invention has been described, the invention is not limited thereto and can be variously modified and changed within the spirit and scope of the invention.

For example, as the embodiment of the invention, although the example case of feeding the ram 330 of the drill unit A as shown in FIG. 1 has been exemplified, the embodiment is not limited thereto; a machine having a reciprocating body is applicable to the invention and other apparatuses are also available for the invention.

Furthermore, in the embodiment of the invention, although a case of using the hydraulic feed-rate control apparatus B at the three-stage feed rates of the creeping speed to the fast speed and again to the creeping speed, it is also possible to use the apparatus B at four or more feed rates by providing the concave portion 32 (FIG. 3A) at two or more places.

Moreover, although the first throttle valve 10 and the second throttle valve 11 has been described by citing a case of providing respective ones as an example, the invention is not limited thereto. For example, if the second inflow port 6*d* are arranged at a plurality of places at positions displaced in the axial direction and positions of inflow ports closed by the auxiliary piston 3 are different, it may be possible to further provide throttle valves and increase their number. If this is made, it becomes possible to adjust feed rates minutely and at plural stages, and to further set the feed rates to be matched with the material of the workpiece W to which the drilling is performed.

What is claimed is:

1. A hydraulic feed-rate control apparatus comprising:

a cylindrical body;

a cylinder provided inside the body;

a main piston reciprocally arranged in the cylinder;

a main-piston rod coupled to the main piston and movably arranged in front and rear directions;

a fluid pressure chamber provided at a front of the main piston and in which a fluid is reserved;

a reservoir chamber provided at a rear of the main piston and in which the fluid is reserved;

flow passages configured to communicate with the reservoir chamber and to be provided between the body and the cylinder;

feed-rate adjustment mechanisms configured to be provided at front ends of the cylinder, to control a flow rate of the fluid flowing into the flow passages from the fluid pressure chamber, and to adjust a moving speed of the main piston; and a differential piston configured to be arranged at a rear of the reservoir chamber and to be movably provided in the front and rear directions with slidingly contacting an inner peripheral face of the body and the main-piston rod, the feed-rate adjustment mechanisms comprising a first throttle valve and a second throttle valve configured to be provided at the front ends of the cylinder and to respectively adjust flow rates of the fluid flowing into the flow passages from the fluid pressure chamber, the main piston comprising an auxiliary piston integrally moving, and opening and closing the second throttle valve, the auxiliary piston comprising:

an outer peripheral portion configured to be fitted in the second throttle valve and to be closed;

a concave portion formed between a front portion and rear portion of the outer peripheral portion;

a circulation hole formed at an inner peripheral portion of the auxiliary piston;

rear-portion escape holes configured to communicate the rear portion of the outer peripheral portion with the circulation hole; and concave-portion escape holes configured to communicate the concave portion with the circulation hole.

2. The hydraulic feed-rate control apparatus according to claim 1, wherein at least one of the first throttle valve and the second throttle valve comprises:

a rotary valve body configured to be freely turnably arranged in the cylinder and including a flow rate adjustment portion configured to be turned and to adjust a flow rate of the fluid flowing into a communication hole from the fluid pressure chamber, the communication hole being bored in the cylinder and communicating with the flow passages;

a knob configured to rotate the rotary valve body; and a rotation stopper configured to regulate turning the knob.

3. The hydraulic feed-rate control apparatus according to claim 2 further comprising at least one of a filter configured to filtrate the fluid passing through the first throttle valve and a filter configured to filtrate the fluid passing through the second throttle valve.

4. The hydraulic feed-rate control apparatus according to claim 1 further comprising at least one of a filter configured to filtrate the fluid passing through the first throttle valve and a filter configured to filtrate the fluid passing through the second throttle valve.

* * * * *